US005104460A

United States Patent [19]

Smith, Jr. et al.

[11] Patent Number: 5,104,460

[45] Date of Patent: Apr. 14, 1992

[54] METHOD TO MANUFACTURE TITANIUM ALUMINIDE MATRIX COMPOSITES

[75] Inventors: Paul R. Smith, Jr., Miamisburg; Daniel Eylon, Dayton; William C. Revelos, Kettering, all of Ohio

[73] Assignee: The United States of America as represented by the Secretary of the Air Force, Washington, D.C.

[21] Appl. No.: 628,955

[22] Filed: Dec. 17, 1990

[51] Int. Cl.[5] ..... C22C 14/00

[52] U.S. Cl. ..... 148/11.5 F; 148/133; 148/407; 148/12.7 B; 420/129; 428/629; 428/660

[58] Field of Search ..... 148/11.5 F, 12.7 B, 148/133, 407; 428/629, 660; 420/129

[56] References Cited

U.S. PATENT DOCUMENTS

| | | | |
|---|---|---|---|
| 4,292,077 | 9/1981 | Blackburn et al. | 75/175.5 |
| 4,499,156 | 2/1985 | Smith et al. | 428/614 |
| 4,716,020 | 12/1987 | Blackburn et al. | 420/418 |
| 4,733,816 | 3/1988 | Eylon et al. | 228/190 |
| 4,746,374 | 5/1988 | Froes et al. | 148/11.5 F |
| 4,774,052 | 9/1988 | Nagle et al. | 420/129 |
| 4,775,547 | 10/1988 | Siemers | 427/34 |
| 4,782,884 | 11/1988 | Siemers | 164/46 |
| 4,786,566 | 11/1988 | Siemers | 428/568 |
| 4,788,035 | 11/1988 | Gigliotti et al. | 420/420 |
| 4,805,294 | 2/1989 | Siemers | 29/527.7 |
| 4,807,798 | 2/1989 | Eylon et al. | 228/190 |
| 4,809,903 | 3/1989 | Eylon et al. | 228/194 |
| 4,816,347 | 3/1989 | Rosenthal et al. | 428/615 |
| 4,919,886 | 4/1990 | Venkataraman et al. | 420/420 |

OTHER PUBLICATIONS

MacKay et al, Jour. of Metals, May 1991, pp. 23–29.

*Primary Examiner*—Upendra Roy

*Attorney, Agent, or Firm*—Charles E. Bricker; Donald J. Singer

[57] ABSTRACT

A method for fabricating a composite structure consisting of a filamentary material selected from the group consisting of silicon carbide, silicon carbide-coated boron, boron carbide-coated boron, titanium boride-coated silicon carbide and silicon-coated silicon carbide, embedded in an alpha-2 titanium aluminide metal matrix, which comprises the steps of modifying the desired filamentary material with at least one beta stabilizer, providing a beta-stabilized $Ti_3Al$ foil, fabricating a preform consisting of alternating layers of foil and a plurality of at least one of the beta stabilizer-coated filamentary materials, and applying heat and pressure to consolidate the preform.

The composite structure fabricated using the method of this invention is characterized by its lack of a denuded zone and absence of fabrication cracking.

3 Claims, 1 Drawing Sheet

METHOD TO MANUFACTURE TITANIUM ALUMINIDE MATRIX COMPOSITES

RIGHTS OF THE GOVERNMENT

The invention described herein may be manufactured and used by or for the Government of the United States for all governmental Purposes without the payment of any royalty.

BACKGROUND OF THE INVENTION

This invention relates to titanium aluminide/fiber composite materials. In particular, this invention relates to a method for manufacturing such composite materials.

In recent years, material requirements for advanced aerospace applications have increased dramatically as performance demands have escalated. As a result, mechanical properties of monolithic metallic materials such as titanium alloys often have been insufficient to meet these demands. Attempts have been made to enhance the performance of titanium by reinforcement with high strength/high stiffness filaments or fibers.

Titanium matrix composites have for quite some time exhibited enhanced stiffness properties which closely approach rule-of-mixtures (ROM) values. However, with few exceptions, both tensile and fatigue strengths are well below ROM levels and are generally very inconsistent.

These titanium matrix composites are typically fabricated by superplastic forming diffusion bonding of a sandwich consisting of alternating layers of metal and fibers. Several high strength/high stiffness filaments or fibers for reinforcing titanium alloys are commercially available: silicon carbide, silicon carbide-coated boron, boron carbide-coated boron, titanium boride-coated silicon carbide and silicon-coated silicon carbide. Under superplastic conditions, which involve the simultaneous application of pressure and elevated temperature for a period of time, the titanium matrix material can be made to flow without fracture occurring, thus providing intimate contact between layers of the matrix material and the fiber. The thus-contacting layers of matrix material bond together by a phenomenon known as diffusion bonding.

Metal matrix composites made from conventional titanium alloys, such as Ti-6Al-4V or Ti-15V-3Cr-3Al-3Sn, can operate at temperatures of about 400° to 1000° F. Above 1000° F. there is a need for matrix alloys with much higher resistance to high temperature deformation and oxidation.

Titanium aluminides based on the ordered alpha-2 $Ti_3Al$ phase are currently considered to be one of the most promising group of alloys for this purpose. However, the $Ti_3Al$ ordered phase is very brittle at lower temperatures and has low resistance to cracking under cyclic thermal conditions. Consequently, groups of alloys based on the $Ti_3Al$ phase modified with beta stabilizing elements such as Nb, Mo and V have been developed. These elements can impart beta phase into the alpha-2 matrix, which results in improved room temperature ductility and resistance to thermal cycling. However, these benefits are accompanied by decreases in high temperature properties. With regard to the beta stabilizer Nb, it is generally accepted in the art that a maximum of about 11 atomic percent (21 wt %) Nb provides an optimum balance of low and high temperature properties in unreinforced matrices.

Titanium matrix composites have not reached their full potential, at least in part, because of problems associated with instabilities at the fiber-matrix interface. At the time of high temperature bonding a reaction can occur at the fiber-matrix interfaces, giving rise to what is called a reaction zone. The compounds formed in the reaction zone may include reaction products such as TiSi, $Ti_5Si$, TiC, TiB and $TiB_2$, when using the commonly used fibers. The thickness of the reaction zone increases with increasing time and with increasing temperature of bonding. The reaction zone surrounding a filament introduces sites for easy crack initiation and propagation within the composite, which can operate in addition to existing sites introduced by the original distribution of defects in the filaments. It is well established that mechanical properties of metal matrix composites are influenced by the reaction zone, and that, in general, these properties are degraded in proportion to the thickness of the reaction zone.

In metal matrix composites fabricated from the ordered alloys of $Ti_3Al+Nb$, the problem of reaction products formed at the metal/fiber interface becomes especially acute, because Nb is depleted from the matrix in the vicinity of the fiber. The thus-beta depleted zone surrounding the fiber is essentially a pure, ordered alpha-2 region with the inherent low temperature brittleness and the low resistance to thermal cycling. The resistance to thermal cycling is generally so low that the material cracks during the thermal cycle associated with fabrication of a metal matrix composite.

Accordingly, it is an object of the present invention to provide a method for fabricating an improved titanium aluminide metal matrix composite.

It is another object of this invention to provide an improved titanium aluminide metal matrix composite.

Other objects, aspects and advantages of the present invention will become apparent to those skilled in the art from a reading of the following detailed description of the invention.

SUMMARY OF THE INVENTION

In accordance with the present invention, there is provided a method for fabricating a composite structure consisting of a filamentary material selected from the group consisting of silicon carbide, silicon carbide-coated boron, boron carbide-coated boron, titanium boride-coated silicon carbide and silicon-coated silicon carbide, embedded in an alpha-2 titanium aluminide metal matrix, which comprises the steps of modifying the desired filamentary material with at least one beta stabilizer, providing a beta-stabilized $Ti_3Al$ foil, fabricating a Preform consisting of alternating layers of foil and a plurality of at least one of the beta stabilizer-coated filamentary materials, and applying heat and pressure to consolidate the preform.

The composite structure fabricated using the method of this invention is characterized by its lack of a denuded zone and absence of fabrication cracking.

DETAILED DESCRIPTION OF THE INVENTION

Figure 1:
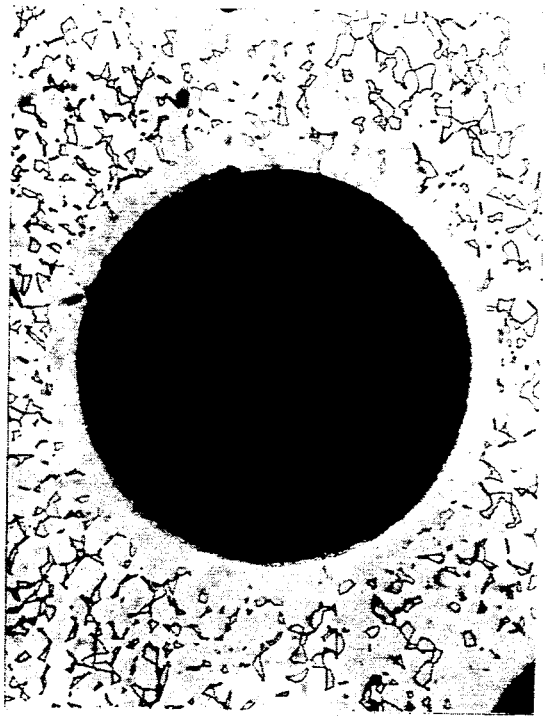
FIG. 1 is a 400× photomicrograph of a portion of a composite prepared using Ti-24Al-llNb (at %) foil and SCS-6 fiber.

The titanium-aluminum alloys suitable for use in the present invention are the alpha-2 alloys containing about 20–30 atomic percent aluminum and about 70–80 atomic percent titanium, and modified with at least one beta stabilizer element, generally about 10–11 atomic percent beta stabilizer, wherein the beta stabilizer is Nb, Mo or V. The presently preferred beta stabilizer is niobium.

The filamentary materials suitable for use in the present invention are silicon carbide, silicon carbide-coated boron, boron carbide-coated boron, titanium boride-coated silicon carbide and silicon-coated silicon carbide.

The fiber is coated or otherwise modified with a desired amount of at least one beta stabilizer. Such modification can be accomplished by techniques known in the art, such as by physical vapor deposition (PVD), ion plating, ion implantation, electrodeposition, sputtering, plasma spraying and the like. The modification should be such as to provide about 30 to 50% additional beta stabilizer, as compared to the quantity of beta stabilizer in the alpha-2 alloy.

The composite preform may be fabricated in any manner known in the art. The quantity of filamentary material included in the preform should be sufficient to provide about 15 to 45, preferably about 35 volume percent fibers.

Consolidation of the filament/alloy preform is accomplished by application of heat and pressure over a period of time during which the matrix material is superplastically formed around the filaments to completely embed the filaments. It is known in the art that a fugitive binder may be used to aid in handling the filamentary material. If such a binder is used, it must be removed without pyrolysis occurring prior to consolidation. By utilizing a press equipped with heatable platens and press ram(s), removal of such binder and consolidation may be accomplished without having to relocate the preform from one piece of equipment to another.

The preform is placed in the consolidation press between the heatable platens and the vacuum chamber is evacuated. Heat is then applied gradually to cleanly off-gas the fugitive binder without pyrolysis occurring, if such binder is used. After consolidation temperature is reached, pressure is applied to achieve consolidation.

Consolidation is carried out at a temperature in the approximate range of 0° to 250° C. (0° to 450° F.) below the beta-transus temperature of the alloy. For example, the consolidation of a composite comprising Ti-24Al-17Nb (at %) alloy, which has a beta-transus temperature of about 1150° C. (2100° F.), is preferably carried out at about 980° C. (1800° F.) to 1100° C. (2010° F.). The pressure required for consolidation of the composite ranges from about 35 to about 300 MPa (about 5 to 40 Ksi) and the time for consolidation ranges from about 15 minutes to 24 hours or more.

The following example illustrates the invention:

EXAMPLE

Metal matrix composites were prepared from Ti-24Al-llNb (at %), each composite having a single layer of SCS-6 fibers. Consolidation of the composites was accomplished at 1900° F. for 3 hours at 10 Ksi.

Figure 2:
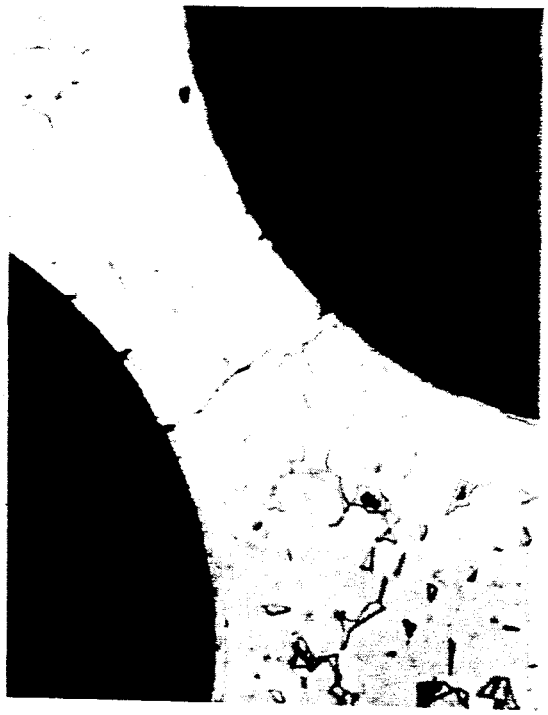
FIG. 2 is a 1000× photomicrograph of a portion of the composite of FIG. 1 showing cracks developed during the thermal cycle.
Figure 3:
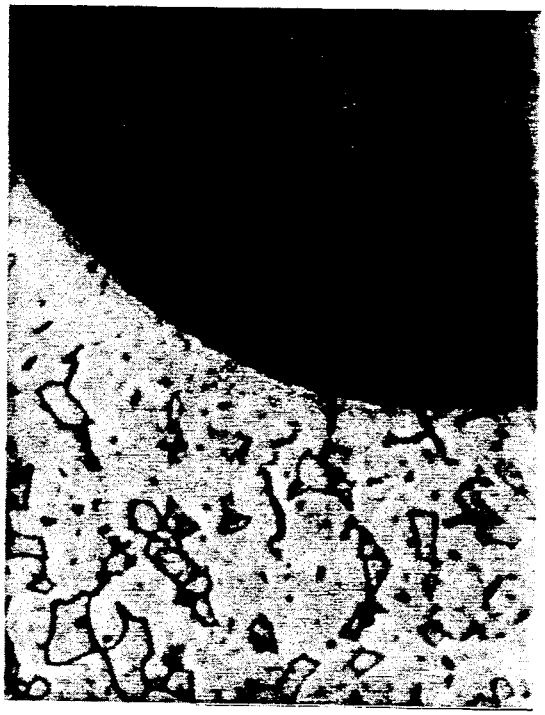
FIG. 3 is a 1000× photomicrograph of a portion of the composite of FIG. 1 showing that cracks developed during the thermal cycle stop at the alpha-2/beta interface.

Referring to FIG. 1, it is readily apparent that a zone of no apparent microstructure immediately surrounds each fiber. This zone is an essentially pure, ordered alpha-2 region, depleted of Nb, and having the inherent low temperature brittleness and low resistance to thermal cycling of alpha-2 $Ti_3Al$. Referring to FIG. 2, thermal cycle cracks can be seen emanating from the fiber into the depleted region. FIG. 3 illustrates how a crack which started in the brittle alpha-2 region was stopped at an alpha-2/beta interface.

Various modifications may be made to the invention as described without departing from the spirit of the invention or the scope of the appended claims.

We claim:

1. A method for manufacturing a composite structure consisting of a filamentary material selected from the group consisting of silicon carbide, silicon carbide-coated boron, boron carbide-coated boron, titanium boride-coated silicon carbide and silicon-coated silicon carbide, embedded in a beta stabilized $Ti_3Al$ matrix, which comprises the steps of providing a beta stabilized $Ti_3Al$ foil containing a quantity of beta stabilizer approximately equal to the desired quantity of beta stabilizer in the matrix portion of said composite structure, modifying said filamentary material to contain at least about 30% of said desired quantity of said beta stabilizer, fabricating a preform consisting of alternating layers of foil and a plurality of at least one of said filamentary materials, and applying heat and pressure to consolidate the preform.

2. The method of claim 1 wherein said beta stabilizer is Nb.

3. The method of claim 1 wherein said filamentary material is modified to contain about 30 to 50% beta stabilizer.

* * * * *